US005961405A

United States Patent [19]

MacKay, Jr.

[11] Patent Number: 5,961,405

[45] Date of Patent: *Oct. 5, 1999

[54] ALUMINUM BAT WITH INTERNAL GROOVES

[75] Inventor: Jack W. MacKay, Jr., Mt. Pleasant, Tex.

[73] Assignee: Hillerich & Bradsby Co., Louisville, Ky.

[ * ] Notice: This patent is subject to a terminal disclaimer.

[21] Appl. No.: 08/967,217

[22] Filed: Oct. 29, 1997

Related U.S. Application Data

[63] Continuation of application No. 08/588,259, Jan. 18, 1996, abandoned, which is a continuation of application No. 08/358,548, Dec. 14, 1984, abandoned, which is a continuation-in-part of application No. 08/099,348, Jul. 30, 1993, Pat. No. 5,421,572.

[51] Int. Cl.[6] ..... A63B 59/06

[52] U.S. Cl. ..... 473/566

[58] Field of Search ..... 473/560

[56] References Cited

U.S. PATENT DOCUMENTS 3,727,295 4/1973 Gildemeirter ..... 273/72 A 3,811,596 5/1974 Wilson ..... 473/566

5,094,453 3/1992 Douglas ..... 273/72 A

*Primary Examiner*—Mark S. Graham

*Attorney, Agent, or Firm*—Middleton & Reutlinger; John F. Salazar; Charles G. Lamb

[57] ABSTRACT

A hollow aluminum bat including a tubular handle portion at one end thereof merging into a tubular barrel at the other end with the barrel having a constant external and internal diameter and a closure end cap is provided with grooves formed in the internal surface of the barrel which reduces the weight of the barrel to enable the barrel to be made with a larger constant diameter throughout its length. The grooves maintain the impact characteristics of the barrel with a ball. The grooves may include a continuous spiral groove having a plurality of closely associated convolutions, a plurality of longitudinally spaced, circumferential grooves, or a plurality of circumferentially spaced longitudinal grooves formed in the interior surface of the constant diameter barrel and oriented over substantially the full length of the accepted hitting zone defined by the barrel.

16 Claims, 1 Drawing Sheet

ALUMINUM BAT WITH INTERNAL GROOVES

This application is a continuation of application Ser. No. 08/588,259, filed Jan. 18, 1996, now abandoned, which is a continuation of application Ser. No. 08/358,548, filed Dec. 14, 1994 now abandoned, which is a continuation-in-part of application U.S. Ser. No. 08/099,348 filed Jul. 30, 1993 for FULL BARREL ALUMINUM BASEBALL BAT AND END CAP now U.S. Pat. No. 5,421,572 issued Jun. 6, 1995.

BACKGROUND OF THE INVENTION

1. Field of the Invention

The present invention generally relates to a hollow aluminum bat including a tubular handle portion at one end thereof merging into a tubular barrel at the other with the barrel having a constant external and internal diameter and a closure end cap. The improvement constituting the present invention is the provision of grooves formed in the internal surface of the barrel which reduces the weight of the barrel to enable the barrel to be made with a larger constant diameter throughout its length with the grooves maintaining the rigidity, resistance to deformation, the trampoline effect and all impact characteristics of the barrel with a ball. The grooves may include a continuous spiral groove having a plurality of closely associated convolutions, a plurality of longitudinally spaced, circumferential grooves, or a plurality of circumferentially spaced longitudinal grooves formed in the interior surface of the constant diameter barrel and oriented over substantially the full length of the accepted hitting zone defined by the barrel.

2. Description of the Prior Art

Hollow aluminum bats including a hollow handle portion and a hollow barrel with an end cap have been well known for many years and are being used by many ball players. The following prior art relates to this field of endeavor.

U.S. Pat. Nos.

3,727,295

3,779,551

3,811,596

3,861,682

3,963,239

Canadian Patent

962291

As discussed in the above-mentioned co-pending application, hollow aluminum bats previously marketed utilized a maximum barrel diameter of 2¾ inches but the end portion of the barrel tapered downwardly to 2⅝ inch in order to accept a 2⅝ inch end cap and also to provide sufficient physical characteristics to the barrel to maintain the impact characteristics with a ball. The above-mentioned co-pending application included a specific end cap and groove in the interior of the end portion of the barrel which cooperated in a manner to enable the barrel to have a constant external diameter up to 2¾ inches throughout its length and still maintain the desired impact characteristics with a ball.

None of the prior art discloses the concept of providing internal grooves in the interior surface of the barrel substantially throughout the length of the barrel to reduce the overall weight of the bat even though the barrel has a constant external diameter up to and including 2¾ inches throughout its length thus enabling the acceptable hitting zone to be extended with the grooves enabling the weight of the bat to be reduced while maintaining the impact characteristics and structural integrity of the barrel.

SUMMARY OF THE INVENTION

An object of the present invention is to provide a hollow metal baseball bat constructed of aluminum in which the barrel which defines the accepted hitting zone has a constant external diameter and internal diameter with the external diameter defining an extended length of the accepted hitting zone and having an end cap. The internal surface of the barrel is provided with a groove, grooves or recesses in the interior surface of the barrel oriented substantially throughout the entire length of the internal surface of the barrel.

Another object of the invention is to provide a hollow aluminum baseball bat provided with groove means in the interior surface of the barrel to reduce the weight of the bat to enable the barrel to be constructed with a larger outside diameter.

A further object of the invention is to provide a hollow aluminum baseball bat having groove means in the interior surface in the barrel to reduce the weight of the bat to enable the barrel to be made with a larger diameter while maintaining the impact characteristics with a ball.

Still another object of the invention is to provide a hollow aluminum baseball bat in accordance with the preceding objects in which the groove means is a continuous spiral groove having a plurality of convolutions formed in the interior surface of the hollow barrel by removing material to maintain a predetermined maximum weight of the bat.

A still further object of the invention is to provide a hollow aluminum bat in accordance with the preceding objects in which the groove means are a plurality of circumferential longitudinally spaced grooves.

Yet another object of the invention is to provide a hollow aluminum bat in accordance with the preceding objects in which the groove means are a plurality of longitudinal circumferentially spaced grooves.

Another distinct and important object of the invention is to provide a hollow aluminum bat with grooves in the internal surface of the barrel in which the grooves dampen vibrations that are frequently transferred to the hands of the batter that grip the handle as a result of impact of the barrel with the ball thereby reducing the vibrations or "sting" which reach the hands of the batter.

A further significant object of the invention is to provide a hollow aluminum bat with grooves in the interior surface thereof to reduce the weight and maintain the same impact characteristics including the same distance upon impact with a ball with the grooves providing stiffness or rigidity to the barrel but yet enabling and maintaining the trampoline effect which occurs when the barrel impacts a ball which results in temporary deformation of the barrel and return to its original position thereby maintaining the same impact characteristics while reducing the weight of the barrel and enabling the diameter of the barrel to be increased up to 2¾ inches and enabling the external diameter of the barrel to be constant throughout the length of the accepted hitting zone continuously to the end of the bat remote from the handle.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
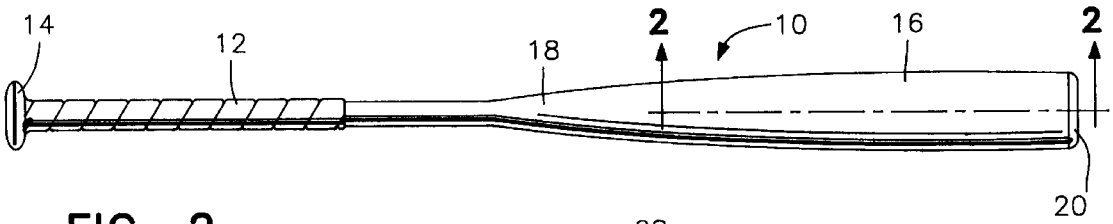
FIG. 1 is a side elevational view of a hollow aluminum bat.

FIG. 1 illustrates a hollow aluminum bat 10 including a handle portion 12 with a knob 14 thereon and a barrel 16 integral with the handle 12 and including a tapered merging portion 18. An end cap 20 is provided in the open end of the barrel 16. The end cap 20 includes a peripheral ridge and groove assembly 22 engaging a peripheral groove and ridge assembly 24 in the internal surface of the barrel in accordance with the structure disclosed in co-pending application Ser. No. 08/099,348 which structure is incorporated herein by reference thereto. As disclosed in the co-pending application, the barrel 16 has a constant external diameter continuously to the end cap which has a portion that is equal to the external diameter of the barrel. The external diameter of the barrel may exceed 2⅝ inches and may be up to and include 2¾ inch diameter to provide a continuous large diameter accepted hitting zone that has effectively been increased in length by not tapering the outer end portion of the barrel down to 2⅝ inch.

Figure 2:
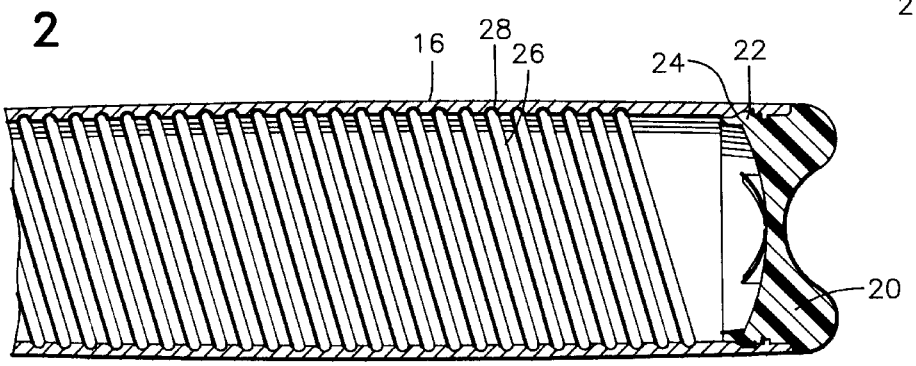
FIG. 2 is a fragmental longitudinal sectional view of a portion of the barrel taken along section line 2—2 on FIG. 1 illustrating a spiral groove formed in the interior surface of the bat barrel.

To reduce the weight of the barrel and enable a larger diameter barrel to be used and to reduce the overall weight of the bat, the barrel 16 is provided with a groove 26 in the interior surface thereof which, as illustrated in FIG. 2, is a continuous spiral groove having a plurality of convolutions extending from the end of the barrel adjacent the end cap inwardly substantially throughout the length of the barrel. As illustrated, the cross-sectional configuration of the groove 26 is generally semi-circular but can be square or rectangular to provide definitive edges or corners 28 which serve to maintain rigidity of the barrel 16 and maintain the impact characteristics of the barrel 16. The cross-sectional configuration of the grooves may vary and the depth of the grooves may vary as well as the space between the convolutions in order to maintain the impact characteristics and provide the desired reduction in weight to enable the larger diameter barrel to be provided with a continuous external diameter throughout its length.

Figure 3:
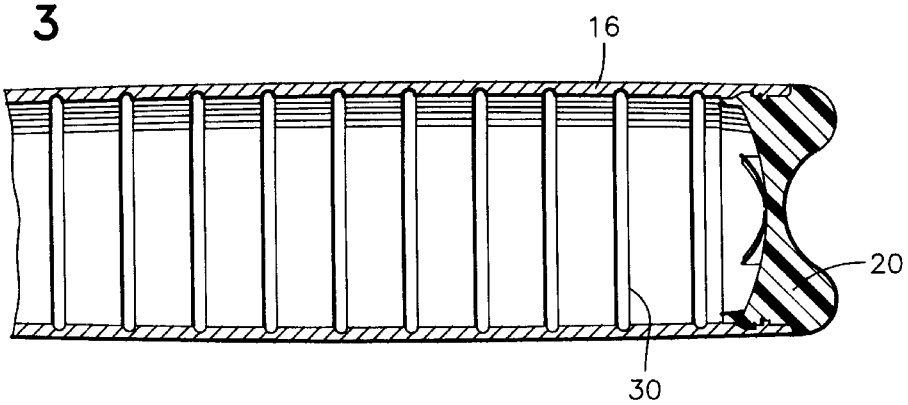
FIG. 3 is a sectional view similar to FIG. 2 and illustrating an arrangement in which a plurality of circumferential grooves that are longitudinally spaced are formed in the interior surface of the barrel.

FIG. 3 illustrates another embodiment of the invention in which the barrel 16 is provided with a plurality of longitudinally spaced circumferentially extending grooves 30. The grooves 30 may be spaced in any desired spacing and vary in depth and be oriented substantially throughout the entire length of the barrel to maintain the impact characteristics and provide the reduction in weight.

Figure 4:
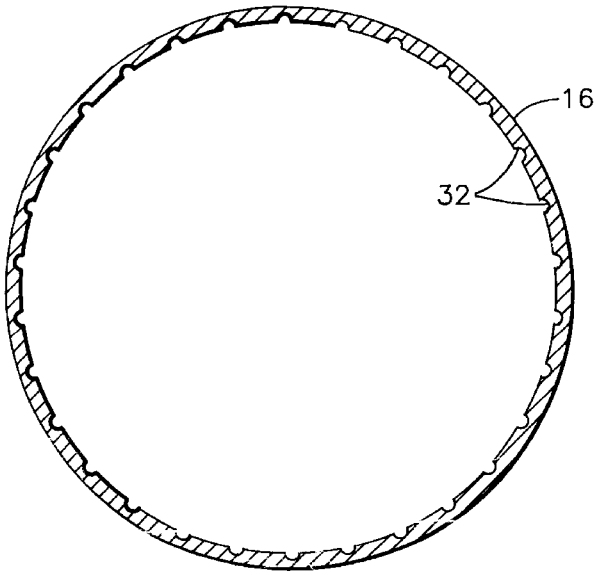
FIG. 4 is a transverse sectional view of a bat barrel illustrating a plurality of circumferentially spaced longitudinal grooves formed in the internal surface of the barrel.

FIG. 4 illustrates another embodiment of the bat in which the barrel 16 is provided with a plurality of circumferentially spaced, longitudinally extending grooves 32. The circumferential spacing, depth and cross-sectional configuration and length of the grooves may vary to maintain the impact characteristics and obtain the desired reduction in weight.

As indicated by the embodiments of the invention disclosed, the groove arrangement may vary as to the spacing between the grooves or the convolutions of the spiral groove. Also, the depth and cross-sectional configuration of the grooves may vary to maintain a predetermined maximum weight and maintain optimum impact characteristics with a ball to obtain maximum ball trajectory distance. The grooves also reduce transfer of vibrations in the bat thus reducing "sting" that sometimes is imparted to the hands of the batter. The groove or grooves preferably extend for distance of about 10 inches from the end cap 20. The incorporation of grooves in the interior surface of the barrel provides a hollow aluminum bat of maximum constant diameter in the barrel with an extended length accepted hitting zone of a constant diameter with a reduced overall weight and maximum impact characteristics.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A metal bat including a tubular handle portion and a hollow tubular barrel portion of a larger diameter than the handle portion with the handle portion and barrel portion being connected by a tapering portion, said barrel portion including a continuous external surface generally defining an accepted hitting zone of the bat for impact with a ball and a continuous open internal surface generally parallel to the external surface terminating in an open barrel end, an end cap inserted into said open barrel end to close said barrel end, said internal surface of the barrel portion including grooving therein which extends from a point near the barrel end along a substantial portion of the internal surface of the barrel portion, said open end of said barrel portion including an internal peripheral groove in adjacent relation to the open end of the barrel portion, said peripheral groove being located between the open end of the barrel portion and said grooving, said end cap including a tubular sleeve of reduced diameter telescoped into the end of the barrel portion and including a peripheral ridge received in said peripheral groove to anchor said end cap in the open end of the barrel portion of the bat, said end cap including a shoulder engaging the end of the barrel portion, said shoulder including an outer diameter generally equal to the outer diameter of the barrel portion.

2. The bat as defined in claim 1 wherein said grooving is a spiral groove.

3. The bat as defined in claim 1 wherein said grooving includes a plurality of circumferentially continuous grooves, said circumferential grooves being longitudinally spaced in relation to each other.

4. The bat as defined in claim 1 wherein said grooving includes a plurality of longitudinally extending grooves.

5. The bat as defined in claim 1 wherein said grooving extends over a distance of approximately 10 inches.

6. The bat as defined in claim 1 wherein said grooving removes a predetermined weight of the bat to enable a larger diameter barrel portion to be utilized while maintaining the total weight of the bat below a pre determined maximum weight.

7. The bat as defined in claim 6 wherein said grooving provides resistance to deformation of the barrel portion while maintaining a trampoline effect resulting from deformation of the barrel portion and a return to the original shape during impact with a ball in order to maintain maximum impact characteristics.

8. The bat as defined in claim 1 wherein said grooving interrupts and dampens vibrations transferred from said barrel to reduce vibrations and "sting" being transmitted to a batter grasping the bat.

9. The bat as defined in claim 1 wherein said end cap includes internal reinforcing ribs to provide increased strength to the outer end of the hitting zone of the bat.

10. A metal baseball bat comprising a tubular barrel having a handle at one end and a full length hitting zone of constant diameter at the other end remote from the handle, said hitting zone having a constant external diameter in excess of 2⅝ inches and up to and including 2¾ inches and being longitudinally straight and including continuous exterior and interior surfaces extending to the end remote from said handle, said interior surface of said barrel including a circular internal groove means formed in the metal defining the interior surface of said barrel, said groove means being positioned adjacent said end of the barrel remote from the handle and an end cap inserted into said barrel with the end cap including a short outer end portion having an external diameter substantially equal to the external diameter of the hitting zone of the barrel and a sleeve of reduced diameter projecting therefrom telescoped into the interior of the hitting zone of the barrel and having a peripheral ridge means spaced from said short outer end portion of said end cap, said ridge means projecting into said internal groove means in the interior surface of the remote end of the bat barrel for anchoring the end cap to the barrel, said end cap including internal reinforcing ribs to provide additional strength to the barrel, said continuous external surface of the hitting zone of the barrel providing additional length to the acceptable hitting zone of the bat, said interior surface of the barrel including grooving therein which extends from a point adjacent said end cap along substantially the entire interior surface of the hitting zone to enable a trampoline effect for the hitting zone when impacting said ball.

11. The bat as defined in claim 10 wherein said grooving extends over a distance of approximately 10 inches.

12. The bat as defined in claim 10 wherein said grooving is a spiral groove.

13. The bat as defined in claim 10 wherein said grooving includes a plurality of circumferentially continuous grooves, said circumferential grooves being longitudinally spaced in relation to each other.

14. The bat as defined in claim 10 wherein said grooving includes a plurality of longitudinally extending grooves.

15. The bat as defined in claim 10 wherein said grooving removes a predetermined weight of the bat to enable a larger diameter barrel portion to be utilized while maintaining the total weight of the bat below a predetermined maximum weight.

16. The bat as defined in claim 10 wherein said grooving interrupts and dampens vibrations transferred from said barrel to reduce vibrations and "sting" being transmitted to a batter grasping the bat.

* * * * *